US010814187B2

(12) United States Patent
Chen et al.

(10) Patent No.: US 10,814,187 B2
(45) Date of Patent: Oct. 27, 2020

(54) BADMINTON RACKET

(71) Applicant: Victor Rackets Industrial Corp., Taipei (TW)

(72) Inventors: Shu-Jung Chen, Taipei (TW); Tzu-Wei Wang, Taipei (TW); Hsin-Chen Wang, Taipei (TW); Cheng-Yu Chang, Taipei (TW)

(73) Assignee: Victor Rackets Industrial Corp., Taipei (TW)

( * ) Notice: Subject to any disclaimer, the term of this patent is extended or adjusted under 35 U.S.C. 154(b) by 0 days.

(21) Appl. No.: 16/592,873

(22) Filed: Oct. 4, 2019

(65) Prior Publication Data

US 2020/0139204 A1 May 7, 2020

(30) Foreign Application Priority Data

Nov. 2, 2018 (TW) ..... 107138970 A

(51) Int. Cl.

| | |
|---|---|
| ***A63B 49/08*** | (2015.01) |
| ***A63B 60/14*** | (2015.01) |
| ***A63B 60/16*** | (2015.01) |
| *A63B 102/04* | (2015.01) |

(52) U.S. Cl.

CPC ..... *A63B 49/08* (2013.01); *A63B 60/14* (2015.10); *A63B 60/16* (2015.10); *A63B 2102/04* (2015.10)

(58) Field of Classification Search

CPC ..... A63B 49/08; A63B 60/14; A63B 60/16; A63B 2102/04

USPC ..... 473/549

See application file for complete search history.

(56) References Cited

U.S. PATENT DOCUMENTS

| | | | | |
|---|---|---|---|---|
| 2,071,684 A * | 2/1937 | Dickson | A63B 49/08 473/548 |
| 4,609,198 A * | 9/1986 | Tarr | A63B 49/035 473/523 |
| 4,989,871 A * | 2/1991 | Sheng | A63B 49/02 473/548 |
| 5,425,534 A | 6/1995 | Chen | |
| 2020/0139204 A1 * | 5/2020 | Chen | A63B 69/0017 |

FOREIGN PATENT DOCUMENTS

| | | | |
|---|---|---|---|
| EP | 1116503 A1 * | 7/2001 | A63B 49/11 |
| FR | 2712196 A3 * | 5/1995 | A63B 60/08 |
| GB | 2160466 A | 12/1985 | |

(Continued)

*Primary Examiner* — Raleigh W Chiu

(74) *Attorney, Agent, or Firm* — Alan D. Kamrath; Mayer & Williams PC

(57) ABSTRACT

The present invention discloses a badminton racket, which includes a frame, a grip, a cap and a shaft. The grip includes a gripping portion, a sleeved portion, and a fastening element connected to the gripping portion. The sleeved portion has a first top surface and a first opening. The fastening element is connected to the first top surface, and the fastening element extends from the first opening to the inside of the gripping portion. The cap is sleeved onto the sleeved portion and has a second top surface and a second opening. There is a spacing length between the first top surface and the second top surface, and the cap has a cap length. The ratio of the spacing length to the cap length is between 0.39 and 0.83. One end of the shaft is connected to the frame, and another end is inserted into the fastening element.

11 Claims, 8 Drawing Sheets

(56) References Cited

FOREIGN PATENT DOCUMENTS

| | | | | | |
|---|---|---|---|---|---|
| GB | 2198649 | A | * | 6/1988 | ..... A63B 49/08 |
| TW | M547410 | U | | 8/2017 | |
| TW | M562151 | U | | 6/2018 | |

* cited by examiner

| | First embodiment | Second embodiment |
|---|---|---|
| softness | 7.3 | 6.4 |
| force transmission | 7.0 | 6.6 |
| vibration | 7.7 | 7.3 |
| comfort | 7.3 | 6.4 |

FIG. 7A

| | Wooden grip | First embodiment |
|---|---|---|
| softness | 6.4 | 7.0 |
| force transmission | 6.8 | 7.4 |
| vibration | 7.4 | 7.7 |
| comfort | 6.4 | 6.8 |

FIG. 7B

BADMINTON RACKET

BACKGROUND

1. Field of the Disclosure

The present disclosure relates to a badminton racket, and particularly to a grip structure of a badminton racket.

2. Description of the Related Art

Badminton is a common and popular racket sport. Badminton gameplay involves a player using a racket to hit a shuttlecock. The main structure of the racket includes a frame, a shaft and a grip, and the shaft is connected to the frame and the grip. Generally, the grip is either a wooden grip or an artificial grip, depending on the material. An artificial grip is usually made of a carbon fiber material.

For the player, a better feeling can be achieved by using a racket with a wooden grip to hit the shuttlecock than by using a racket with an artificial grip. However, the weight of the wood varies, and the supply also varies, so such a design is prone to a shortage of wood. To solve this problem, a racket with an artificial grip is provided. At present, the most common artificial grip is made of a carbon fiber material. The frame, the shaft and the grip are integrally formed to achieve a lightweight effect. For example, the relative positions of the shaft and the grip are fixed when the shuttlecock is hit, so the shaft has no buffer space for moving, which reduces the activity (degree of freedom) of the shaft, thereby making the hitting feeling unsatisfactory and the structural strength poor.

Therefore, a badminton racket with an artificial grip should be provided to solve the problems of the variable weight and the supply shortage of the wooden grip, and also the problem of the conventional artificial grip not effectively performing the function of the shaft and thereby making the hitting feeling unsatisfactory.

SUMMARY

In view of the above issues, it is a primary objective of the present disclosure to provide a badminton racket with an increased spacing length between the sleeved portion and the cap to the increase the degree of freedom of the shaft and thereby to solve the problem of the conventional artificial grip not effectively performing the function of the shaft and the resultant unsatisfactory hitting feeling.

To achieve the above objective, the present disclosure provides a badminton racket, which comprises a frame, a grip, a cap and a shaft. The grip comprises a gripping portion, a sleeved portion and a fastening element. The gripping portion has a front end. The sleeved portion is connected to the front end of the gripping portion. The sleeved portion has a first top surface and a first opening, and the first opening is located on the first top surface. The interior of the gripping portion and the sleeved portion communicate with each other to form a hollow structure. The fastening element is connected to the first top surface and extends from the first opening to the interior of the gripping portion. The cap is sleeved onto the sleeved portion of the grip. The cap has a second top surface and a second opening, and the second opening is located on the second top surface. The first top surface and the second top surface have a spacing length therebetween, and the cap has a cap length. The ratio of the spacing length to the cap length is between 0.39 and 0.83. One end of the shaft is connected to the frame, and the other end is inserted into the fastening element through the second opening and the first opening sequentially.

According to an embodiment of the present disclosure, the spacing length is between 17 mm and 30 mm.

According to an embodiment of the present disclosure, the fastening element is located inside the sleeved portion and the gripping portion.

According to an embodiment of the present disclosure, the ratio of the length of the fastening element to the length of the grip is between 0.59 and 0.79.

According to an embodiment of the present disclosure, the grip has a plurality of supporting elements disposed in the grip. Each of the supporting elements has a front edge and a posterior edge; the front edge is connected an inner side wall of the sleeved portion, and the posterior edge is connected to an outer side wall of the fastening element and an inner side wall of the gripping portion.

According to an embodiment of the present disclosure, the supporting element has a recess located at the front edge, and the recess has a predetermined length and a predetermined width.

According to an embodiment of the present disclosure, the predetermined length is between 10 mm and 20 mm and the predetermined width is between 0.3 mm and 2 mm.

According to an embodiment of the present disclosure, the recess is a kerf extending from the front edge to the posterior edge.

According to an embodiment of the present disclosure, the posterior edge of the supporting elements is an oblique angle.

According to an embodiment of the present disclosure, each of the supporting elements has a connecting side surface connected to the inner side wall of the gripping portion, the posterior edge and the connecting side surface have a predetermined angle therebetween, and the predetermined angle is between 15 degrees and 45 degrees.

According to an embodiment of the present disclosure, the predetermined angle is 30 degrees.

As described above, according to the badminton racket and the grip of the present disclosure, the ratio of the spacing length to the cap length is limited to between 0.39 and is 0.83 by defining the spacing length between the grip of the sleeved portion and the cap. When a user uses the badminton racket (or the badminton racket with a grip of the present disclosure) of the present disclosure to hit the shuttlecock, the buffer space for movement of the shaft should be increased by increasing the space between the cap and the grip, thereby improving the hitting feeling of the badminton racket.

BRIEF DESCRIPTION OF THE DRAWINGS

FIG. 7A is a table listing the results of sensation tests of the grip of the first embodiment and the second embodiment of the present disclosure; and FIG. 7B is a table listing the results of sensation tests of the grip of the first embodiment of the present disclosure and the wooden grip.

DETAILED DESCRIPTION OF THE PREFERRED EMBODIMENT

Hereafter, the technical content of the present disclosure will be better understood with reference to preferred embodiments.

Figure 1:
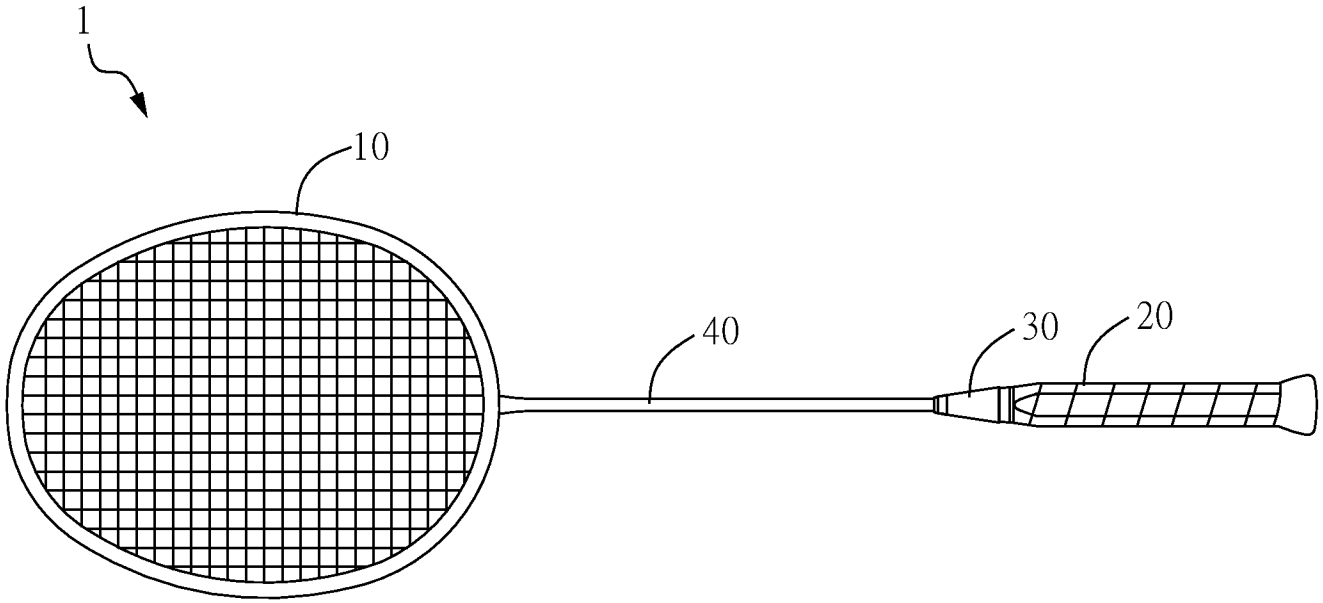
FIG. 1 is a schematic diagram of a badminton racket according to a first embodiment of the present disclosure.
Figure 2:
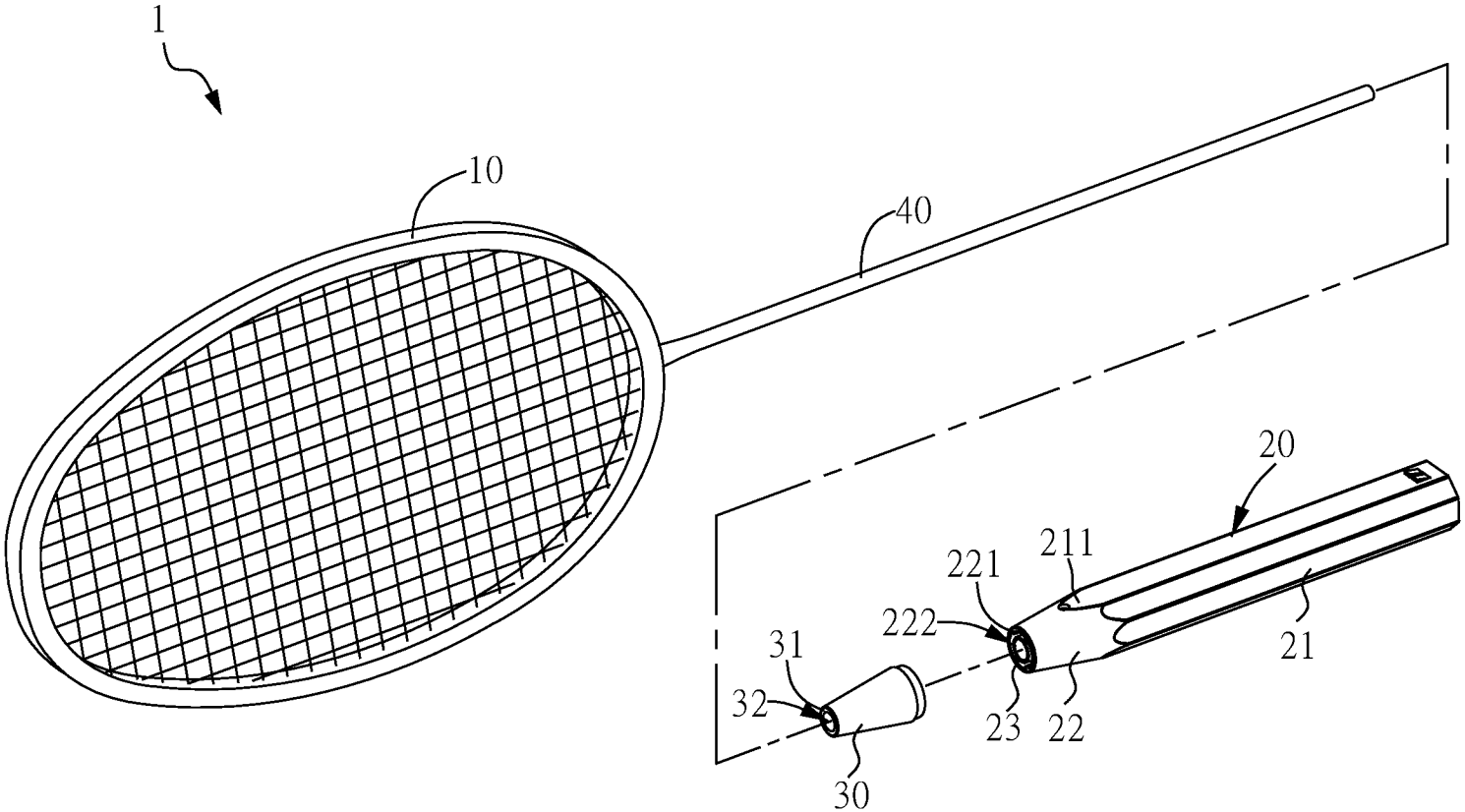
FIG. 2 is an exploded view of the badminton racket shown in FIG. 1.

FIG. 1 is a schematic diagram of a badminton racket according to a first embodiment of the present disclosure; FIG. 2 is an exploded view of the badminton racket shown in FIG. 1. Please refer to FIG. 1 and FIG. 2. In this embodiment, the badminton racket 1 comprises a frame 10, a grip 20, a cap 30 and a shaft 40. One end of the shaft 40 is connected to the frame 10, and the other end of the shaft 40 is connected to the cap 30 and the grip 20. The grip 20 comprises a gripping portion 21, a sleeved portion 22 and a fastening element 23. The gripping portion 21 has a front end 211, and the sleeved portion 22 is connected to the front end 211 of the gripping portion 21. Specifically, in this embodiment, the portion of the cylinder-like structure of the grip 20 is referred to as the gripping portion 21, and the portion of the flat-topped cone-like structure connected to the front end 211 of the gripping portion 21 is referred to as the sleeved portion 22. Further, the gripping portion 21 is for the user (player) to hold, and the sleeved portion 22 is for the cap 30 to sleeve onto, so the configuration of the sleeved portion 22 and the cap 30 can be matched to each other.

Figure 3:
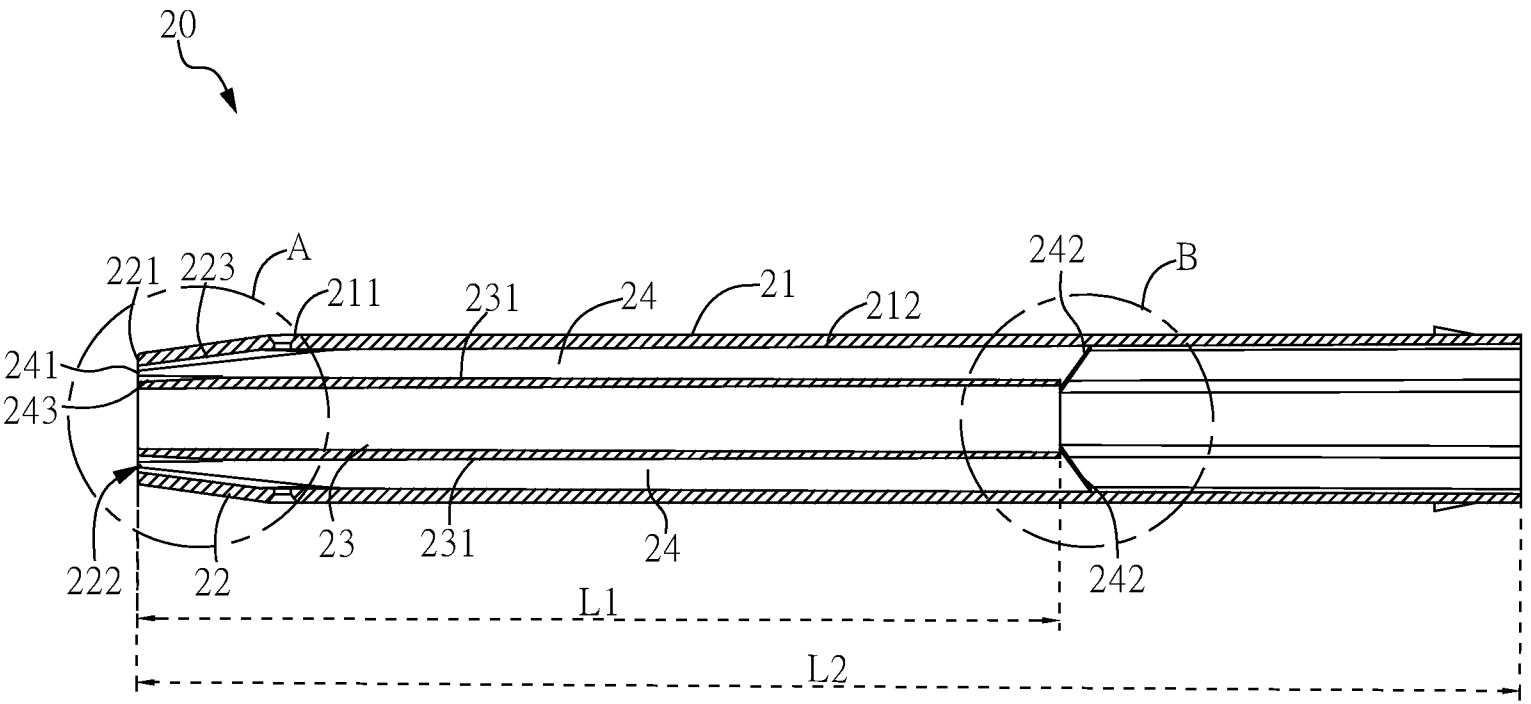
FIG. 3 is a sectional view of the grip shown in FIG. 1.

FIG. 3 is a sectional view of the grip shown in FIG. 1. Please refer to FIG. 2 and FIG. 3. It should be noted that the grip 20 as shown in FIG. 3 is the grip 20 of the first embodiment. In this embodiment, the interior of the gripping portion 21 and the sleeved portion 22 communicate with each other to form a hollow structure, thereby achieving lightweight effect. In addition, the sleeved portion 22 has a first top surface 221 and a first opening 222, and the first top surface 221 is located at the opposite side of the front end 211 of the gripping portion 21, which is the side away from the gripping portion 21. The first opening 222 is located on the first top surface 221; that is, the first opening 222 is disposed on the first top surface 221 such that the shaft 40 can be inserted into the hollow structure in the sleeved portion 22 and gripping portion 21 through the first opening 222.

The fastening element 23 is connected to the first top surface 221 and extends from the first opening 222 to the interior of the gripping portion 21. In other words, the front end of the fastening element 23 is connected to the sleeved portion 22, and another portion of the fastening element 23 is located on the interior of the sleeved portion 22 and the gripping portion 21. Furthermore, the fastening element 23 of this embodiment is a tubular structure to accommodate the shaft 40. Preferably, the ratio of a length L1 of the fastening element 23 to a length L2 of the grip 20 is between 0.59 and 0.79. For example, if the length L1 of the fastening element 23 is 110 mm, then the length L2 of the grip 20 is between 165 mm and 185 mm.

The cap 30 is a hollow, flat-topped, cone-like structure, and the inner diameter of the cap 30 is greater than the inner diameter of the sleeved portion 22 such that the cap 30 can be sleeved onto the sleeved portion 22 of the grip 20. Further, the cap 30 has a second top surface 31 and a second opening 32, and the second opening 32 is located on the second top surface 31. The frame 10 and the shaft 40 are integrally formed; that is, one end of the shaft 40 is fixed to the frame 10. After the cap 30 is assembled to the sleeved portion 22 of the grip 20, the other end of the shaft 40 passes through the second opening 32 and the first opening 222 sequentially and is inserted into the fastening element 23. When the user (player) uses the badminton racket 1 of this embodiment to hit the shuttlecock, the force applied to the shaft 40 can be dispersed to the fastening element 23 by the structure of the shaft 40 fixed by the fastening element 23. Therefore, the situation of the stress focusing on the shaft 40 can be avoided to increase the structural strength and improve the hitting feel provided by the badminton racket 1.

Figure 4:
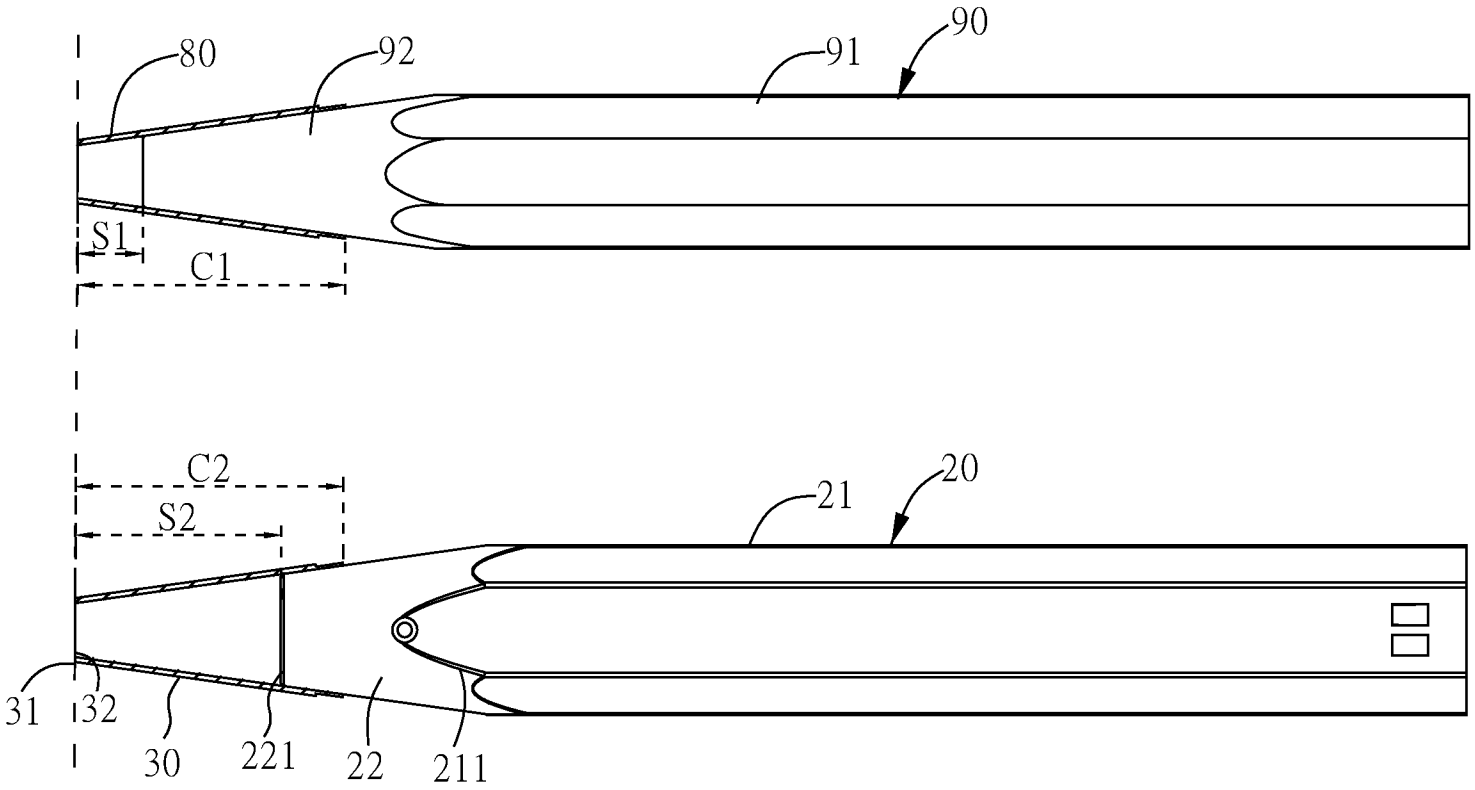
FIG. 4 is a cutaway view of the conventional wooden grip and the grip and the cap shown in FIG. 3.

FIG. 4 is a cutaway view of the conventional wooden grip and the grip and the cap shown in FIG. Please refer to FIG. 4. The wooden grip 90 has a gripping portion 91 and a sleeved portion 92. Generally, after the cap 80 is sleeved onto the sleeved portion 92 of the wooden grip 9, there is a portion of space between the cap 80 and the sleeved portion 92. In other words, a top surface of the cap 80 and a top surface of the sleeved portion 92 have a spacing length S1 therebetween. Generally, a cap length C1 of the cap 80 is between 36 mm and 43.5 mm, a cap length C1 of 41 mm is used as an example, and the spacing length S1 is about 9 mm.

In this embodiment, the buffer space for the shaft 40 to move is increased by increasing the space between the cap 30 and the grip 20, thereby improving the hitting feeling provided by the badminton racket 1. Specifically, the first top surface 221 and the second top surface 31 have a spacing length S2 therebetween in this embodiment, and the cap 30 has a cap length C2. The ratio of the spacing length S2 to the cap length C2 is between 0.39 and 0.83. It should be noted that the size and the specifications of the cap 30 of the present embodiment are substantially the same as those of the conventional cap 80, so the cap length C2 is also between 36 mm and 43.5 mm, and 41 mm is used as an example. Further, in this embodiment, the spacing length S2 is between 17 mm and 30 mm.

In the manufacturing process of the grip 20 of the present embodiment, the ratio of the spacing length S2 to the cap length C2 of the aforementioned embodiment can be achieved by reducing the length of the sleeved portion 22 of the grip 20. For example, the length of the sleeved portion 92 of the wooden grip 90 is defined as 1; the length of the sleeved portion 22 of the present embodiment can be reduced to 0.5. That is, the length of the sleeved portion 22 of the present embodiment is ½ of the length of the conventional sleeved portion 92.

Figure 5B:
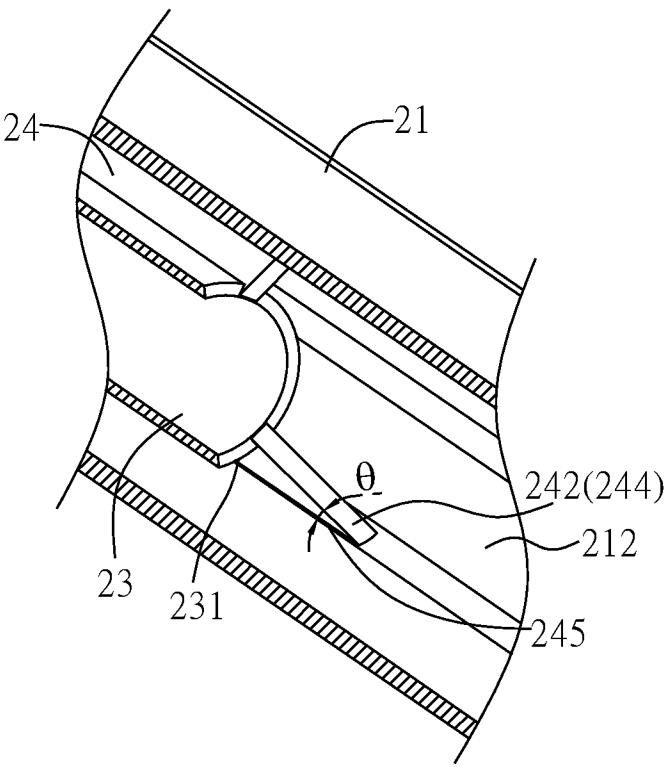
FIG. 5B is an enlarged view of area B shown in FIG. 3.
Figure 5A:
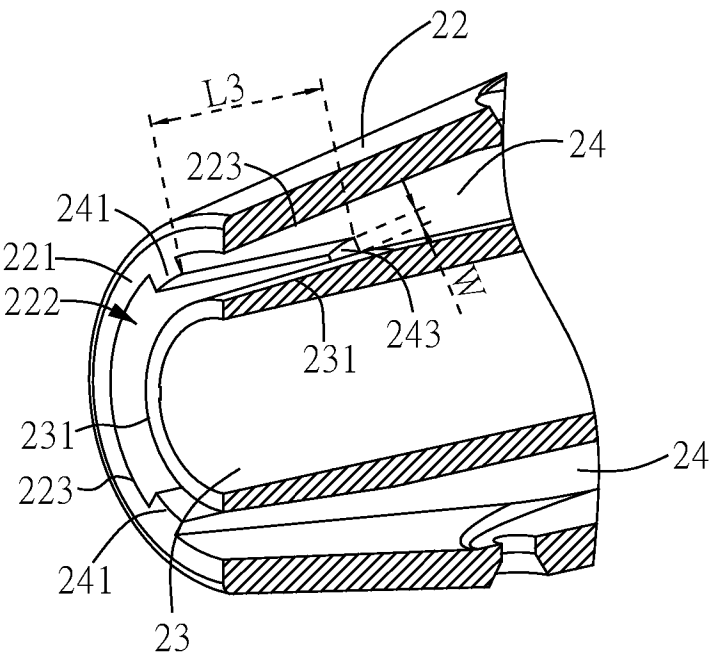
FIG. 5A is an enlarged vie of area A shown in FIG. 3.

As shown in FIG. 3, the grip 20 has a plurality of supporting elements 24 disposed inside the grip 20. One side surface of a supporting element 24 is connected to an inner side wall 223 of the sleeved portion 22 and an inner side wall 212 of the gripping portion 21, and the other side surface of a supporting element 24 is connected to an outer side wall 231 of the fastening element 23. FIG. 5A is an enlarged view of area A shown in FIG. 3; FIG. 5B is an enlarged view of area B shown in FIG. 3. Please refer to FIG. 3, FIG. 5A and FIG. 5B. Each of the supporting elements 24 has a front edge 241 (as shown in FIG. 5A) and a posterior edge 242 (as shown in FIG. 5B). Preferably, in this embodiment, the front edge 241 of the supporting element 24 is only connected to the inner side wall 223 of the sleeved portion 22 and is not connected to the outer side wall 231 of the fastening element 23*a*. The posterior edge 242 of the supporting element 24 is connected to the outer side wall 231 of the fastening element 23 and the inner side wall 212 of the gripping portion 21 simultaneously. In other words, the supporting element 24 of the present embodiment has a recess 243 located on the front edge 241. The recess 243 has a predetermined length is L3 and a predetermined width W. The predetermined length L3 is between 10 mm and 20 mm, and the predetermined width W is between 0.3 mm and 2 mm. Preferably, the predetermined width W is between 0.65 mm and 1.26 mm.

Figure 6A:
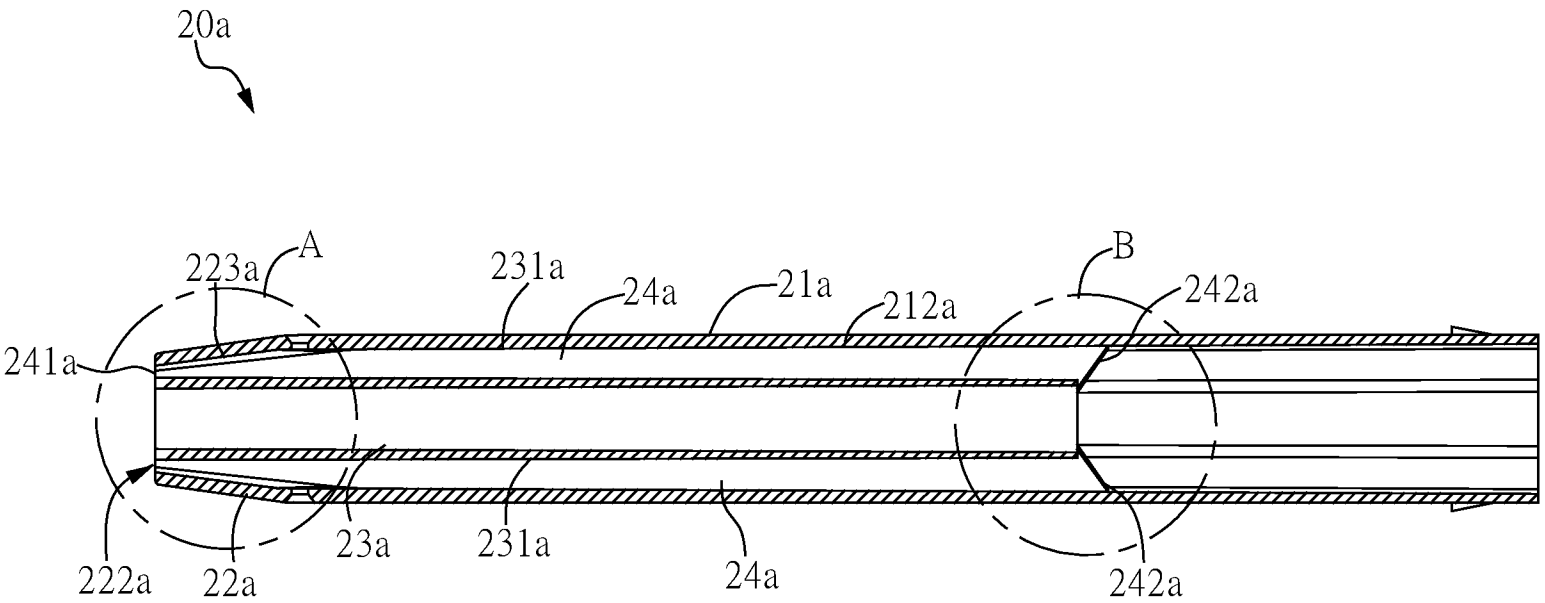
FIG. 6A is a schematic diagram of a grip according to a second embodiment of the present disclosure.
Figure 6C:
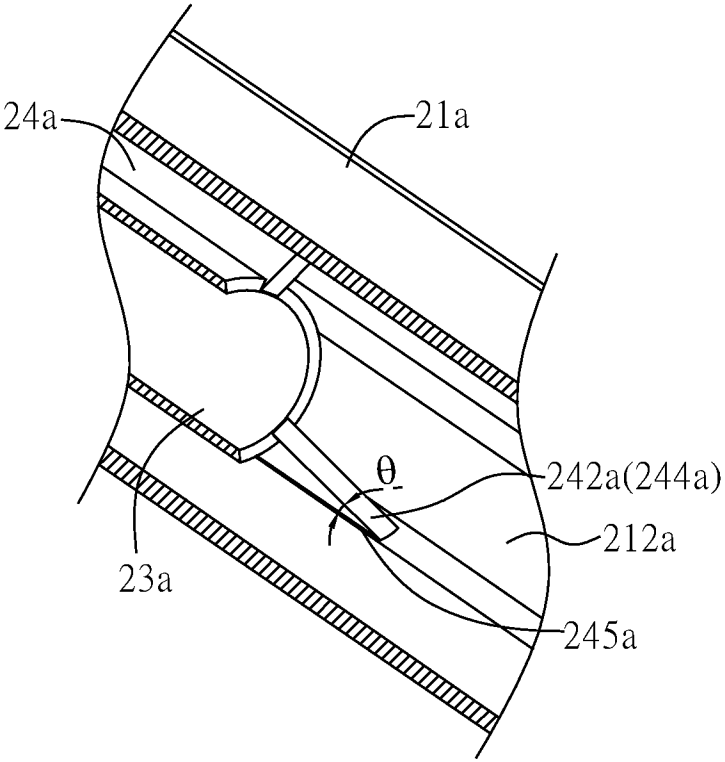
FIG. 6C is an enlarged view of area B shown in FIG. 6A.
Figure 6B:
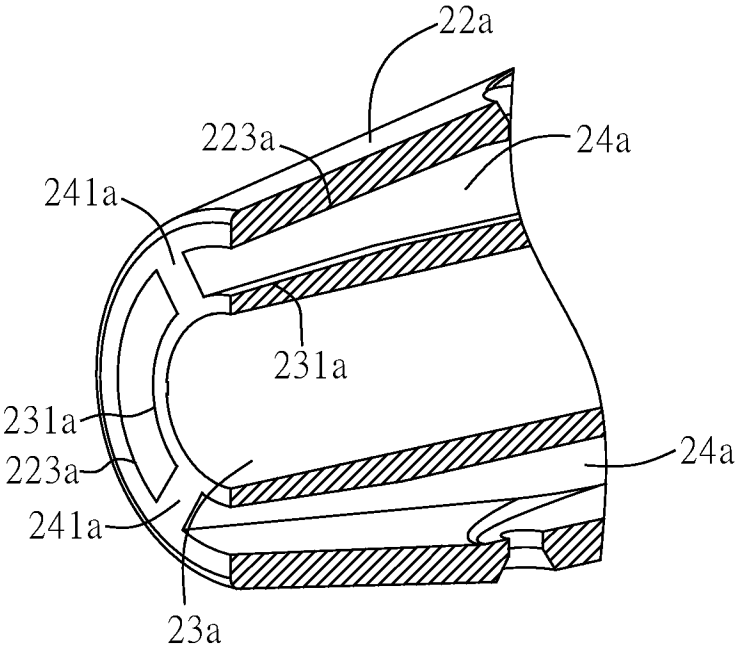
FIG. 6B is an enlarged view of area A shown in FIG. 6A.

In other embodiments, the supporting elements 24*a* can be an integrated structure without a recess, as shown in FIG. 6A. FIG. 6A is a schematic diagram of a grip according to a second embodiment of the present disclosure, FIG. 6B is an enlarged view of area A shown in FIG. 6A, and FIG. 6C is an enlarged view of area B shown in FIG. 6A. Please refer to FIG. 6A and FIG. 6B first. In this embodiment, the front edge 241*a* and the posterior edge 242*a* of the supporting element 24*a* are both connected to the outer side wall 231*a* of the fastening element 23*a*. Specifically, the front edge 241*a* is connected to the inner side wall 223*a* of the sleeved portion 22*a* and the outer side wall 231*a* of the fastening element 23*a*. Further, the posterior edge 242*a* is connected to the inner side wall 212*a* of the gripping portion 21*a* and the outer side wall 231*a* of the fastening element 23*a*.

Please refer to FIG. 5B and FIG. 6C. Preferably, the posterior edge 242 (242*a*) of the supporting elements 24 (24*a*) in the first (second) embodiment can be an oblique angle 244 (244*a*), and the following description employs the grip 20 of the first embodiment as an example. Specifically, the supporting element 24 has a connecting side surface 245 connected to the inner side wall 212 of the gripping portion 21. That is, the side surface to which the supporting element 24 and the inner side wall 212 of the gripping portion 21 are connected is called a connecting side surface 245. Further, the posterior edge 242 and the connecting side surface 245 have a predetermined angle therebetween, and the predetermined angle is between 15 degrees and 45 degrees. Preferably, the predetermined angle is 30 degrees.

In the manufacturing process of the badminton racket of the present invention, the grip 20*a* of the second embodiment is formed by injection molding first; that is, the integrated supporting elements 24*a* are formed first; and then the grip 20 of the first embodiment is formed by a hollow cylindrical treatment tool, which forms the recess 243 at the front edge 241*a* of each supporting element 24*a*. Specifically, the grip 20*a* of the second embodiment is made of plastic materials with a density between 0.9 g/cm$^3$ and 1.46 g/cm$^3$ by injection molding. In other words, the gripping portion 21*a*, the sleeved portion 22*a*, the fastening element 23*a*, and the (integrated) supporting elements 24*a* are integrally formed as one piece. Please refer to FIG. 6A. Then the hollow cylindrical treatment tool is inserted form the first opening 222*a* in the sleeved portion 22*a*, and the treatment tool modifies the front edge 241*a* (to form the recess 243) of the supporting elements 24*a* in a rotating manner. The grip 20 of the first embodiment and the supporting elements 24 thereof can be made by the above-mentioned method, and each supporting element 24 of the first embodiment has a kerf extending from the front edge 241 to the posterior edge 242. In other words, the kerf made by the hollow cylindrical treatment tool is the recess 243. It should be noted that an outer diameter of the treatment tool is smaller than an inner diameter of the first opening 222*a* of the sleeved portion 22*a*, and an inner diameter of the treatment tool is slightly larger than an outer diameter of the fastening element 23*a*, such that the hollow cylindrical treatment tool can be inserted into the sleeved portion 22*a* and sleeved onto the outside of the fastening element 23*a*.

A plurality of users (players) used the badminton racket comprising the grips 20, 20*a* of the first and the second embodiments to perform sensation (hitting feeling) tests, and the test results are shown in FIG. 7A. FIG. 7A is a table listing the results of sensation tests of the grip of the first embodiment and the second embodiment of the present disclosure. Generally, the sensation tests of the badminton racket were scored on a scale of 9 points by each player (user) for softness, force transmission, vibration and comfort when hitting the shuttlecock. Regarding the softness, a hard and moderate hitting feeling is more suitable for smashing. As shown in FIG. 7A, when hitting the shuttlecock with the grip 20 of the first embodiment, the feeling of softness is harder than that of the grip 20*a* of the second embodiment, so the grip 20 is more suitable for smashing. Regarding the force transmission, a higher score indicates a better effect of force transmission. The force transmission effect of the grip 20 of the first embodiment is superior to the grip 20*a* of the second embodiment. Regarding the property of vibration, a higher score indicates lower vibration when hitting. The vibration of the grip 20 of the first embodiment is lower than the vibration of the grip 20*a* of the second embodiment such that the user can more easily control the shuttlecock. Further, in terms of the property of comfort, the comfort of the grip 20 of the first embodiment is better than that of the grip 20*a* of the second embodiment. Therefore, the grip 20 of the first embodiment is superior to the grip 20*a* of the second embodiment as a whole. The reason is that the front edges 241 of the supporting elements 24 are only connected to the inner side wall 223 of the sleeved portion 22 and are not connected to the outer side wall 231 of the fastening element 23. In other words, the recess 243 is formed at the front edge 241 of the supporting elements 24 to increase the buffer space for the shaft 40 to move by the design of the unintegrated structure of the supporting elements 24 such that the hitting feeling of the grip 20 of the first embodiment is superior to the hitting feeling of the grip 20*a* of the second embodiment.

The users used the badminton racket comprising the grip 20 (the first embodiment) having the superior hitting feeling and the wooden grip 9 to perform sensation (hitting feeling) tests, and the results are shown in FIG. 7B. FIG. 7B is a table listing the results of a sensation test of the grip of the first embodiment of the present disclosure and the wooden grip. When a user hits the shuttlecock while using the grip 20 of the first embodiment, the feeling of softness is harder than the feeling of softness of the wooden grip 90, so the grip 20 is more suitable for smashing than the wooden grip 90 is. Further, in terms of the effect of force transmission and the property of vibration and comfort, the grip 20 of the first embodiment is superior to the wooden grip 90. It should be noted that, although FIG. 7A and FIG. 7B do not show the sensation (hitting feeling) tests comparing the grip 20*a* of the second embodiment and the wooden grip 90, based on the results shown in FIG. 7A and FIG. 7B, it can be inferred that the hitting feeling of the grip 20*a* (the second embodiment) is substantially the same as that of the wooden grip 90.

Moreover, the present disclosure also provides a grip connected to a shaft of a badminton racket. The grip includes a gripping portion, a sleeved portion and a fastening element, and the structure and the connection are the same as those of the grips 20, 20*a* of the above embodiments, so they will not be described in detail herein.

As described above, according to the badminton racket and the grip of the present disclosure, the ratio of the spacing length to the cap length is limited to between 0.39 and 0.83 by defining the spacing length between the grip of the sleeved portion and the cap. When a user uses the badminton racket (or the badminton racket with a grip of the present disclosure) of the present disclosure to hit a shuttlecock, the buffer space for the movement of the shaft should be increased by increasing the space between the cap and the grip, thereby improving the hitting feeling of the badminton racket.

Furthermore, the grip has a plurality of supporting elements, and the front edge of each supporting element is only connected to the inner side wall of the sleeved portion to form a recess at the front edge. This design can increase the buffer space for movement of the shaft such that the badminton racket comprising the grip of the present disclosure is superior to a badminton racket comprising the wooden grip.

It should be noted that the described embodiments are only for illustrative and exemplary purposes and that various changes and modifications may be made to the described embodiments without departing from the scope of the disclosure as disposed by the appended claims.

What is claimed is:

1. A badminton racket, comprising:

a frame;

a grip, comprising:

a gripping portion having a front end;

a sleeved portion connected to the front end of the gripping portion, the sleeved portion having a first top surface and a first opening, the first opening being located on the first top surface, the interior of the gripping portion and the sleeved portion communicating with each other to form a hollow structure; and a fastening element connected to the first top surface and extending from the first opening to the interior of the gripping portion;

a cap sleeved on the sleeved portion of the grip, the cap having a second top surface and a second opening, the second opening being located on the second top surface, the first top surface and the second top surface having a spacing length therebetween, the cap having a cap length, and the ratio of the spacing length to the cap length being between 0.39 and 0.83; and a shaft, one end of the shaft being connected to the frame, the other end being inserted into the fastening element through the second opening and the first opening sequentially.

2. The badminton racket as claimed in claim 1, wherein the spacing length is between 17 mm and 30 mm.

3. The badminton racket as claimed in claim 1, wherein the fastening element is located inside the sleeved portion and the gripping portion.

4. The badminton racket as claimed in claim 3, wherein the ratio of the length of the fastening element to the length of the grip is between 0.59 and 0.79.

5. The badminton racket as claimed in claim 3, wherein the grip has a plurality of supporting elements disposed in the grip, each of the supporting elements having a front edge and a posterior edge, the front edge being connected an inner side wall of the sleeved portion, and the posterior edge being connected to an outer side wall of the fastening element and an inner side wall of the gripping portion.

6. The badminton racket as claimed in claim 5, wherein the supporting element has a recess located at the front edge, and the recess has a predetermined length and a predetermined width.

7. The badminton racket as claimed in claim 6, wherein the predetermined length is between 10 mm and 20 mm and the predetermined width is between 0.3 mm and 2 mm.

8. The badminton racket as claimed in claim 6, wherein the recess is a kerf extending from the front edge to the posterior edge.

9. The badminton racket as claimed in claim wherein the posterior edge of the supporting elements is an oblique angle.

10. The badminton racket as claimed in claim 9, wherein each supporting element has a connecting side surface connected to the inner side wall of the gripping portion, the posterior edge and the connecting side surface having a predetermined angle therebetween, and the predetermined angle is between 15 degrees and 45 degrees.

11. The badminton racket as claimed in claim 10, wherein the predetermined angle is 30 degrees.

* * * * *